US011466637B2

(12) United States Patent
Kato et al.

(10) Patent No.: US 11,466,637 B2
(45) **Date of Patent: *Oct. 11, 2022**

(54) INJECTION CONTROL DEVICE

(71) Applicant: DENSO CORPORATION, Kariya (JP)

(72) Inventors: Kosuke Kato, Kariya (JP); Hiroyuki Fukuda, Kariya (JP); Yasumasa Ishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/476,239

(22) Filed: Sep. 15, 2021

(65) Prior Publication Data

US 2022/0090556 A1 Mar. 24, 2022

(30) Foreign Application Priority Data

Sep. 18, 2020 (JP) ..... JP2020-157467

(51) Int. Cl.
*F02D 41/20* (2006.01)
*F02D 41/22* (2006.01)

(52) U.S. Cl.
CPC ..... *F02D 41/20* (2013.01); *F02D 41/22* (2013.01); *F02D 2041/2003* (2013.01); *F02D 2041/224* (2013.01); *F02D 2200/0614* (2013.01)

(58) Field of Classification Search
CPC .. F02D 41/20; F02D 41/22; F02D 2041/2003; F02D 2041/224; F02D 2200/0614
See application file for complete search history.

(56) References Cited

U.S. PATENT DOCUMENTS 8,300,438 B1 * 10/2012 Herbert ..... H02M 1/4216 363/124
10,462,397 B1 * 10/2019 Eshel ..... H04N 5/3575
2015/0354522 A1 * 12/2015 Hoban, Jr. ..... G01R 31/52 73/114.45
2017/0104480 A1 * 4/2017 Eshel ..... H01L 27/14609
2017/0335789 A1 11/2017 Kiuchi
2020/0072153 A1 3/2020 Inaba
2022/0090555 A1 * 3/2022 Takaya ..... F02D 41/247

FOREIGN PATENT DOCUMENTS

JP 2016-183597 A 10/2016

* cited by examiner

*Primary Examiner* — John Kwon
*Assistant Examiner* — Johnny H Hoang
(74) *Attorney, Agent, or Firm* — Posz Law Group, PLC

(57) ABSTRACT

An injection control device controls fuel injection to an internal-combustion engine by driving a fuel injection valve with an electric current to open and close the valve. The injection control device includes a boost circuit boosting a battery voltage; a boost controller controlling the boosting of the boost circuit; and a charge control setter setting charge permission or charge prohibition of the boost circuit to the boost controller. The charge control setter sets the charge permission or charge prohibition of the boost circuit to the boost controller according to a magnitude of an influence of a drive current error.

7 Claims, 7 Drawing Sheets

INJECTION CONTROL DEVICE

CROSS REFERENCE TO RELATED APPLICATION

The present application is based on and claims the benefit of priority of Japanese Patent Application No. 2020-157467, filed on Sep. 18, 2020, the disclosure of which is incorporated herein by reference.

TECHNICAL FIELD

The present disclosure generally relates to an injection control device that controls fuel injection to an internal-combustion engine by driving a fuel injection valve with an electric current to open and close the valve.

BACKGROUND ART

The injection control device controls fuel injection to an internal-combustion engine such as a gasoline engine of an automobile by driving a fuel injection valve, i.e., an injector, with an electric current to open and close the valve. The injection control device applies a high voltage to the fuel injection valve to control valve opening. That is, the injection control device includes a boost circuit that boosts a battery voltage, which is a reference power supply voltage of a power supply circuit, and a boost controller that boosts and controls the boost circuit, and boosts the battery voltage by the boost circuit to generate a boost voltage. Then, the generated boost voltage is applied to the fuel injection valve to control valve opening.

SUMMARY

It is an object of the present disclosure is to provide an injection control device that is capable of appropriately suppressing an influence of a drive current error on an injection amount, appropriately improving an injection accuracy, and appropriately reserving a rechargeable time.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
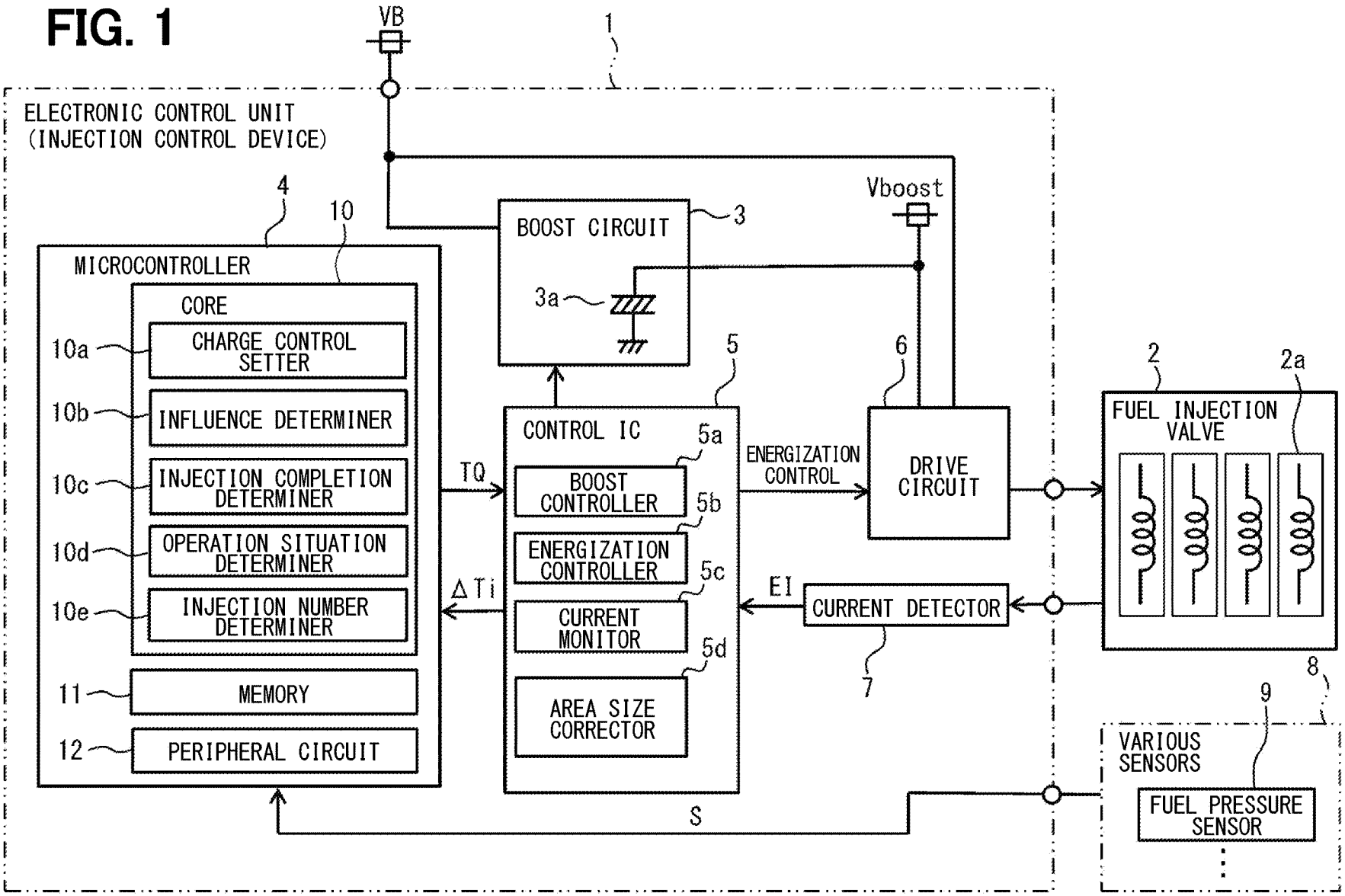
FIG. 1 is a functional block diagram showing an embodiment and showing an electrical configuration.

Hereinafter, an embodiment applied to direct injection control of a gasoline engine (i.e., an internal-combustion engine) of an automobile will be described with reference to the drawings. An electronic control device 1 as an injection control device according to the present embodiment may also be called as an ECU (Electronic Control Unit), and as shown in FIG. 1, controls fuel injection of a fuel injection valve 2 provided in each cylinder of the engine. The fuel injection valve 2 may also be called as an injector, and by energizing a solenoid coil 2*a* to drive a needle valve, fuel is directly injected into each cylinder of the engine. Note that a 4-cylinder engine illustrated in FIG. 1 can also be a 3-cylinder, 6-cylinder, 8-cylinder, or the like. Further, it can also be applied to an injection control device of a diesel engine.

The electronic control device 1 includes a boost circuit 3, a microcontroller 4, a control IC 5, a drive circuit 6, and a current detector 7. The microcontroller 4 includes one or a plurality of cores 10, a memory 11 such as a ROM and a RAM, and a peripheral circuit 12 such as an A/D converter. The microcontroller 4 inputs a sensor signal S from various sensors 8 for detecting an operating state of the engine and the like. As will be described later, the microcontroller 4 calculates an energization instruction TQ based on the program stored in the memory 11 and the sensor signals S and the like input from the various sensors 8.

The various sensors 8 include a fuel pressure sensor 9 that detects a fuel pressure when injecting fuel. Although not shown, in addition to the fuel pressure sensor 9, the various sensors 8 include a water temperature sensor for detecting temperature of a cooling water of the engine, an A/F sensor for detecting an air-fuel ratio of the exhaust gas, a crank angle sensor for detecting a crank angle, an air flow meter for detecting an amount of intake air of the engine, a throttle opening sensor for detecting a throttle opening, and the like. In FIG. 1, various sensors 8 are shown in a simplified manner.

In the microcontroller 4, the core 10 grasps an engine load from the sensor signals S input from the various sensors 8, and calculates a required fuel injection amount of the fuel injection valve 2 based on the engine load. When the core 10 calculates the required fuel injection amount of the fuel injection valve 2, the core 10 calculates an indicated energization time Ti of the energization instruction TQ based on the calculated fuel injection amount and the fuel pressure detected by the fuel pressure sensor at the time of injecting the fuel. The core 10 calculates an injection instruction timing for each cylinder from the sensor signals S input from the various sensors 8, and outputs the energization instruction TQ to the control IC 5 at the calculated injection instruction timing. In such case, although detailed description is omitted, the core 10 calculates an A/F correction amount so as to reach a target air-fuel ratio based on an air-fuel ratio detected by the A/F sensor, and performs air-fuel ratio feedback control. Further, the core 10 performs A/F learning based on a history of A/F correction, and adds/considers the learning correction value to/in the calculation of the A/F correction amount.

The control IC 5 may be, for example, an integrated circuit device using an ASIC, and, although not shown, may include, for example, a logic circuit, a controlling subject realized by a CPU or the like, a storage unit such as a RAM, a ROM or an EEPROM, a comparison unit using a comparator or the like. The control IC 5 performs controls of electric current of the fuel injection valve 2 via the drive circuit 6 according to its hardware and software configuration. The control IC 5 has functions as a boost controller 5*a*, an energization controller 5*b*, a current monitor 5*c*, and an area size corrector 5*d*.

Although not shown, the boost circuit 3 inputs a battery voltage VB, boosts the input battery voltage VB, and charges a boost capacitor 3*a* as a charging unit with a boost voltage Vboost to a full charge voltage. The battery voltage VB is, for example, 12 volts, and the boost voltage Vboost is, for example, 65 volts. The boost voltage Vboost is supplied to the drive circuit 6 as electric power for driving the fuel injection valve 2. The boost controller 5*a* controls the boost circuit 3 to boost the voltage, and controls the charging of the boost circuit 3.

The drive circuit 6 inputs the battery voltage VB and the boost voltage V boost. Although not shown, the drive circuit 6 includes a transistor for applying the boost voltage Vboost to the solenoid coil 2*a* of the fuel injection valve 2 of each cylinder, a transistor for applying the battery voltage VB, and a transistor for selecting a cylinder to be energized and the like. Each transistor of the drive circuit 6 is ON/OFF controlled by the energization controller 5*b*. The drive circuit 6 drives the fuel injection valve 2 by applying a voltage to the solenoid coil 2*a* based on the energization control by the energization controller 5*b*.

The current detector 7 is composed of a current detection resistor (not shown) or the like, and detects electric current flowing through the solenoid coil 2*a*. The current monitor 5*c* is composed of, for example, a comparator, an A/D converter and the like (not shown), and monitors an energizing current value El actually flowing through the solenoid coil 2*a* of the fuel injection valve 2 of each cylinder by the current detector 7.

The control IC 5 stores an energizing current profile PI showing an ideal relationship between an energization time Ti and the energizing current value El so as to obtain an energizing current integrated value of the fuel injection valve 2 according to the energization instruction TQ input from the microcontroller 4. The energization controller 5*b* performs current control for controlling electric current of the fuel injection valve 2 via the drive circuit 6 based on the energizing current profile PI. In the control of the fuel injection valve 2, a gradient of the energizing current of the fuel injection valve 2 is lower than the energizing current profile PI due to various factors such as an ambient temperature environment and aging deterioration, thereby, under such circumstances, lowering the actual injection amount than the instructed injection amount. On the other hand, when the fuel injection valve 2 is energized and controlled, a fuel injection amount proportional to the integrated value of the energizing current can be obtained.

The area size corrector 5*d* calculates an area correction amount based on a difference between the integrated current of the energizing current profile PI and the integrated current of the energizing current value El actually flowing through the fuel injection valve 2 detected by the current detector 7, for making the two current values even/equal to each other, and then calculate an energization time correction amount ΔTi. In such case, the area size corrector 5*d* calculates a time to reach a first current threshold and a time to reach a second current threshold, respectively for the energizing current profile PI and for the energizing current value El, for example, and an area difference is estimated from the calculated times, and an area correction amount for obtaining an area equivalent to the estimated area difference is calculated as the energization time correction amount ΔTi. The area size corrector 5*d* may adopt a method other than the above, may calculate the area correction amount, and may calculate the energization time correction amount ΔTi. The area size corrector 5*d* performs the current area correction, corrects the energization time of the energization instruction TQ according to the energization time correction amount ΔTi, and achieves a calculation of an appropriate fuel injection amount for the fuel injection valve 2, according to the corrected energization instruction TQ after correcting the energization time thereof. Note that the area size corrector 5*d* outputs the energization time correction amount ΔTi calculated in the above-described manner to the microcontroller 4.

In the injection control device 1, charging noise may be generated by the boost control, and when the energizing current of the fuel injection valve 2 is monitored to control valve opening/closing, the charging noise generated by the boost control is transmitted in the wiring board or in the power supply system path, which results in a situation of deteriorated accuracy of the current monitoring. Therefore, there is a configuration in which boost control is prohibited for a certain period of time so that the adverse effect/negative influence of the generation of charging noise does not affect/deteriorate the drive current error, but in such a configuration, the rechargeable time per cycle of the internal-combustion engine is reduced, thereby making it impossible to secure a sufficient rechargeable time. Further, it is conceivable that the boost circuit 3 is provided as a circuit capable of high-speed charging, but in such a configuration in which a circuit capable of high-speed charging is provided, new problems such as an increase in size and cost increase arise.

Therefore, in the present embodiment, the following configuration is adopted. The core 10 has functions as a charge control setter 10*a*, an influence determiner 10*b*, an injection completion determiner 10*c*, an operation situation determiner 10*d*, and an injection number determiner 10*e*.

The charge control setter 10*a* outputs a charge permission instruction to the boost controller 5*a*, and sets a charge permission of the boost circuit 3 to the boost controller 5*a*. In such case, the boost controller 5*a* drives the boost circuit 3 when the charge permission is set by the charge control setter 10*a* by inputting the charge permission instruction from the charge control setter 10*a*, and charges the boost voltage Vboost to the boost capacitor 3*a* to bring it to a full charge voltage. On the other hand, the charge control setter 10*a* outputs a charge prohibition instruction to the boost controller 5*a*, and sets a charge prohibition of the boost circuit 3 to the boost controller 5*a*. In such case, the boost controller 5*a* stops the boost circuit 3 when the charge prohibition is set by the charge control setter 10*a* by inputting the charge prohibition instruction from the charge control setter 10*a*. In such case, by stopping the boost circuit 3, charging noise due to boost control is not generated, and the current monitoring accuracy is not deteriorated.

Figure 2:
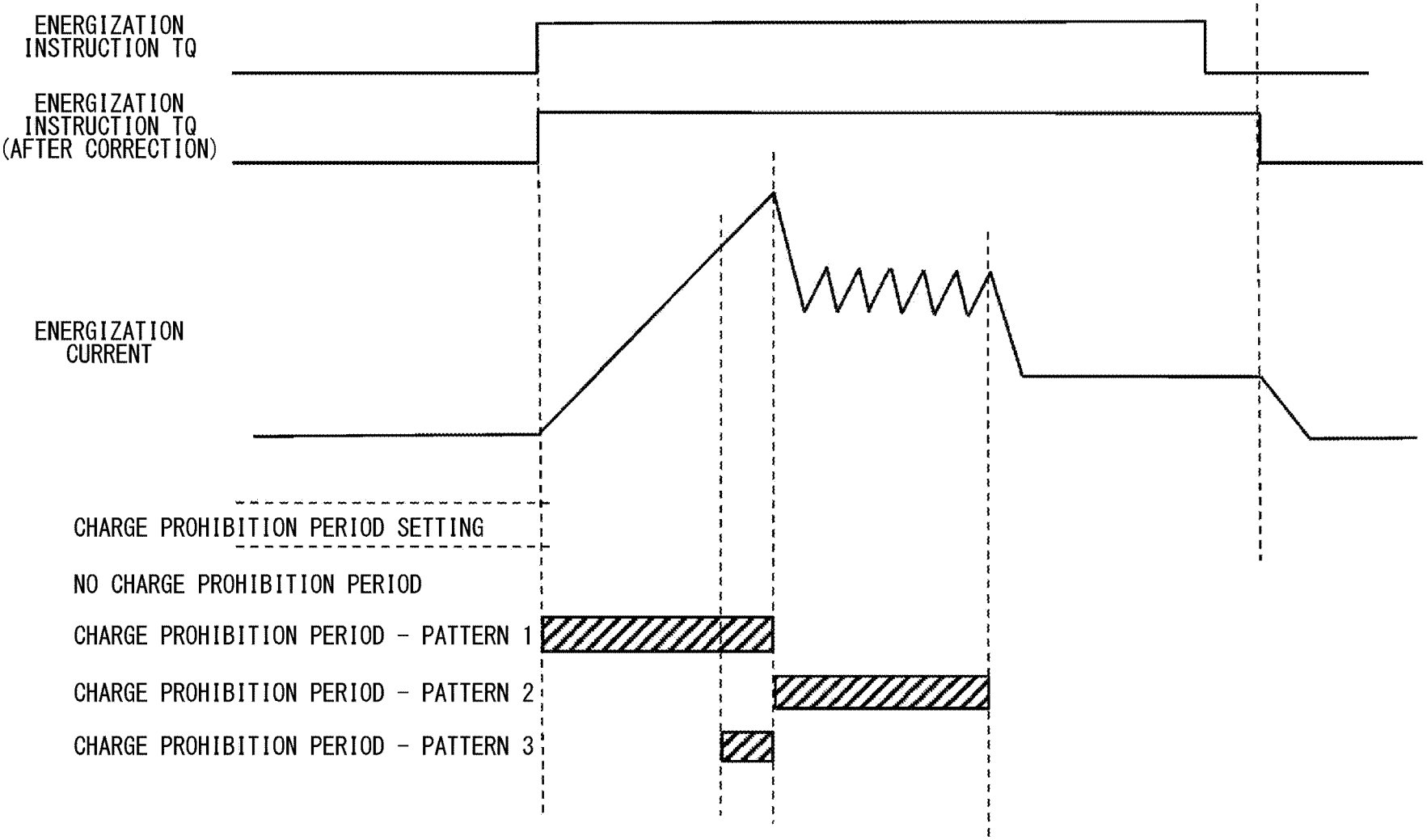
FIG. 2 is a timing chart.

Here, discharge control is described. As shown in FIG. 2, when the injection instruction timing is reached, the injection control device 1 switches the energization instruction TQ from OFF to ON, starts supplying the energizing current to the fuel injection valve 2, and supplies a peak current and a constant current to the fuel injection valve 2. When the supply of the energizing current to the fuel injection valve 2 is started, the fuel injection valve 2 is opened, a lift amount of the needle valve is increased, and fuel is injected into the cylinder of the engine.

The charge control setter 10*a* outputs, during a period of performing such discharge control, a charge prohibition instruction to the boost controller 5*a* as follows, and stops the boost circuit 3 in a charge prohibition period designated by the charge prohibition instruction.

In such case, the charge control setter 10*a* can arbitrarily set the charge prohibition period. For example, as pattern 1, the charge control setter 10*a* sets a period from (a) a switching timing of the energization instruction TQ from OFF to ON to (b) a timing when the energizing current reaches a peak value of the peak current as a charge prohibition period. For example, as pattern 2, the charge control setter 10*a* sets a period from (a) a timing when the energizing current reaches the peak value of the peak current to (b) a timing when a final peak value of the constant current is reached as a charge prohibition period. For example, as pattern 3, the charge control setter 10*a* sets a period from (a) a certain time before the energizing current reaches the peak value of the peak current to (b) a timing when the peak value of the peak current is reached as a charge prohibition period. Note that, in the present embodiment, three patterns are exemplarily illustrated as patterns for arbitrarily setting the charge prohibition period. However, the charge prohibition period may be set as a pattern other than the illustrated patterns.

The influence determiner 10*b* determines a magnitude of the influence of the drive current error on the injection amount. The influence determiner 10*b* determines a type of injection, and when it determines that it is a microinjection or a learning microinjection, it determines that the influence of the drive current error on the injection amount is large, while it is determined that the influence of the drive current error on the injection amount is small when determining that the type of injection is a normal injection. Further, the influence determiner 10*b* determines a pulsation of the fuel pressure, and when it determines that the pulsation of the fuel pressure is equal to or higher than a preset level, it determines that the influence of the drive current error on the injection amount is large, while it is determined that the influence of the drive current error on the injection amount is small when determining that the pulsation is less than the preset level.

The injection completion determiner 10*c* determines whether or not an injection of the fuel injection valve 2 is complete. In such case, the injection completion determiner 10*c* determines whether or not the injection of the fuel injection valve 2 is complete by determining whether or not a valve closing detection is complete, and when it is determined that the valve closing detection is complete, it is determined that the injection of the fuel injection valve 2 is complete. On the other hand, when the injection completion determiner 10*c* determines that the valve closing detection is not complete, it determines that the injection of the fuel injection valve 2 is not complete.

The operation situation determiner 10*d* determines whether or not an operation situation is a predetermined situation. The predetermined situation referred to here is an extremely low temperature engine start in which the engine is started under an extremely low temperature condition, a rapid warming of the catalyst in which the catalyst is rapidly warmed up and activated, or a stratified start in which two layers of air-fuel mixture having two different air-fuel ratios or two different fuel concentrations are combusted for the start of the engine, or fuel-efficiency pursuing stratified combustion in which such two layers of air-fuel mixture are combusted for the improved fuel efficiency. That is, the predetermined situation is an engine-hardly-startable situation. The injection number determiner 10*e* compares the number of injections with a preset number, and determines whether or not the number of injections is equal to or less than the preset number.

Next, the operation of the above configuration will be described with reference to FIGS. 3 to 9. In the following, the discussion involves (i) a charge control process for determining a charge control for each injection and (ii) a charge control process for determining the charge control for each cylinder.

(1) Charge Control Process for each Injection

Figure 3:
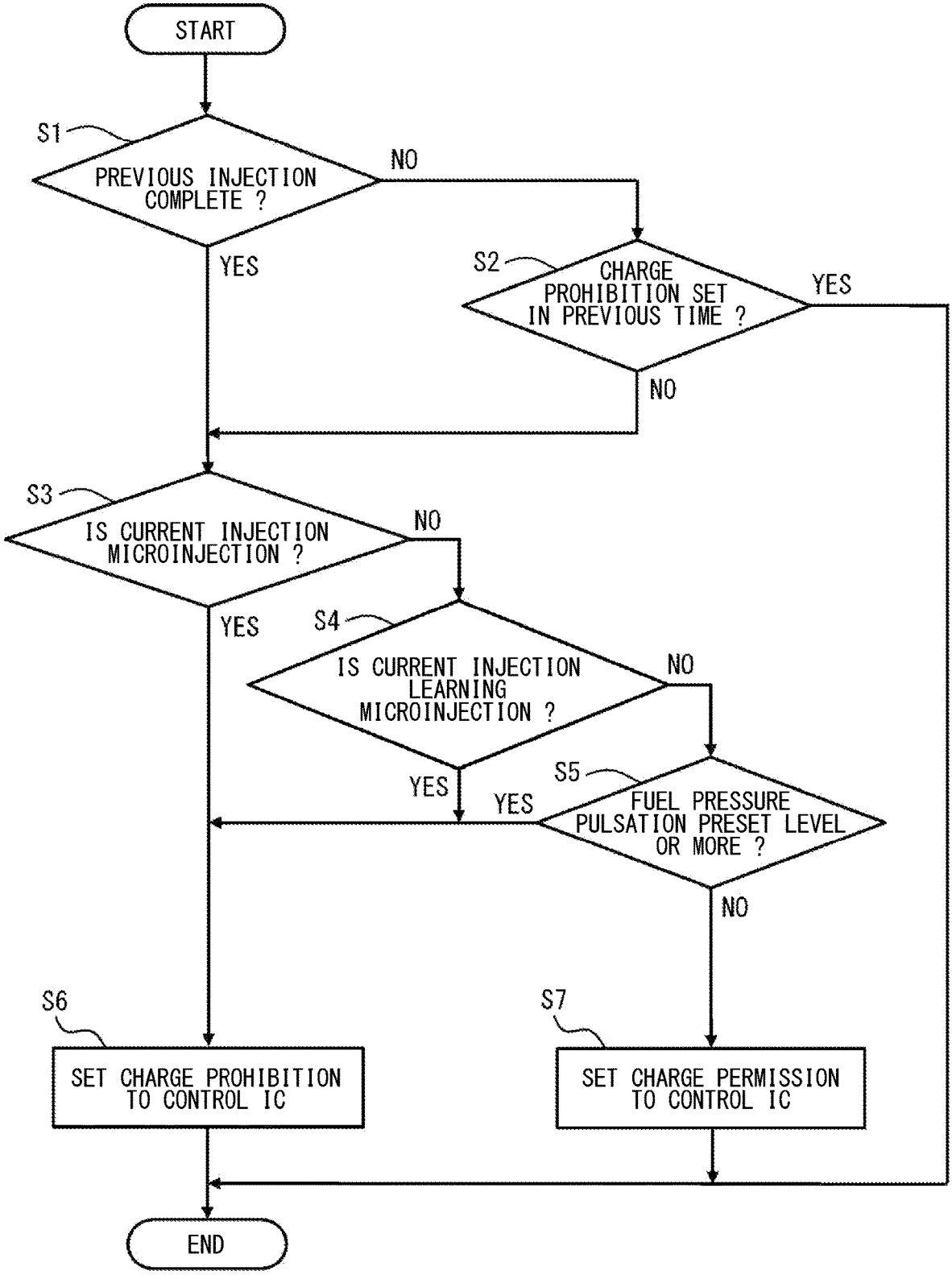
FIG. 3 is a flowchart (No. 1)

In the microcontroller 4, the core 10 starts the charge control process for each injection every time a start event of the charge control process for each injection occurs. As shown in FIG. 3, when the charge control process for each injection is started, the core 10 determines whether or not a previous injection is complete (S1). When the core 10 determines that the previous injection has not been complete (S1: NO), the core 10 determines whether or not a charge prohibition of the boost circuit 3 was set in previous time (S2). When the core 10 determines that the charge prohibition of the boost circuit 3 has been set in previous time (S2: YES), the core 10 ends the charge control process for each injection, and waits for the occurrence of a next start event.

When the core 10 determines that the previous injection has been complete (S1: YES), or determines that the charge prohibition of the boost circuit 3 has not been set last time (S2: NO), it is determined whether or not the current injection is a microinjection (S3). When the core 10 determines that the current injection is a microinjection (S3: YES), the core 10 outputs a charge prohibition instruction to the boost controller 5*a*, and sets charge prohibition of the boost circuit 3 to the boost controller 5*a* (S6), and the charge control process for each injection is complete, and stands by for the next start event.

When the core 10 determines that the current injection is not a microinjection (S3: NO), the core 10 determines whether or not the current injection is a learning microinjection (S4). When the core 10 determines that the current injection is a learning microinjection (S4: YES), the core 10 also outputs a charge prohibition instruction to the boost controller 5*a*, and sets, to the boost controller 5*a*, charge prohibition of the boost circuit 3 (S6), and ends the charge control process for each injection, and waits for the occurrence of the next start event.

When the core 10 determines that the current injection is not a learning microinjection (S4: NO), the core 10 determines whether or not a pulsation of the fuel pressure is a preset level or more (i.e., greater) (S5). When the core 10 determines that the pulsation of the fuel pressure is equal to or more than a preset level (S5: YES), the core 10 also outputs a charge prohibition instruction to the boost controller 5*a*, and sets, to the boost controller 5*a*, charge prohibition of the boost circuit 3 (S6), and ends the charge control process for each injection, and waits for the occurrence of the next start event.

When the core 10 determines that the pulsation of the fuel pressure is not equal to or more than a preset level (S5: NO), the core 10 outputs a charge permission instruction to the boost controller 5*a*, and sets, to the boost controller 5*a*, the charge permission of the boost circuit 3 (S7), and ends the charge control process for each injection, and waits for the next start event.

The core 10 switches the charge control for the boost circuit 3 as follows by performing the charge control process described above.

Figure 4:
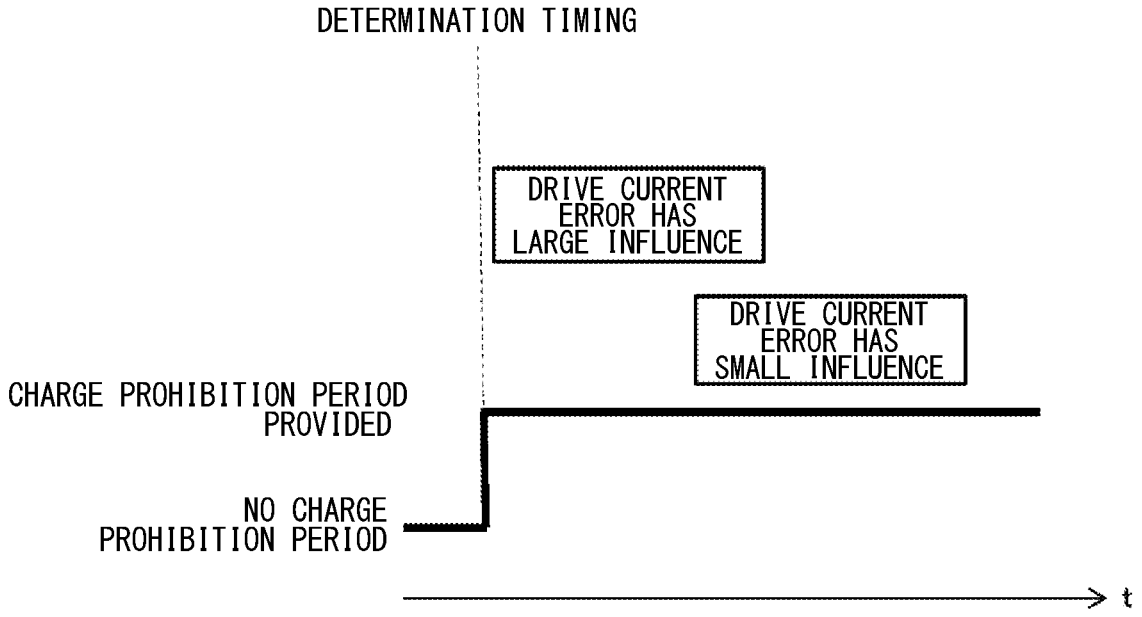
FIG. 4 is a diagram for explaining a charge prohibition period (No. 1)
Figure 5:
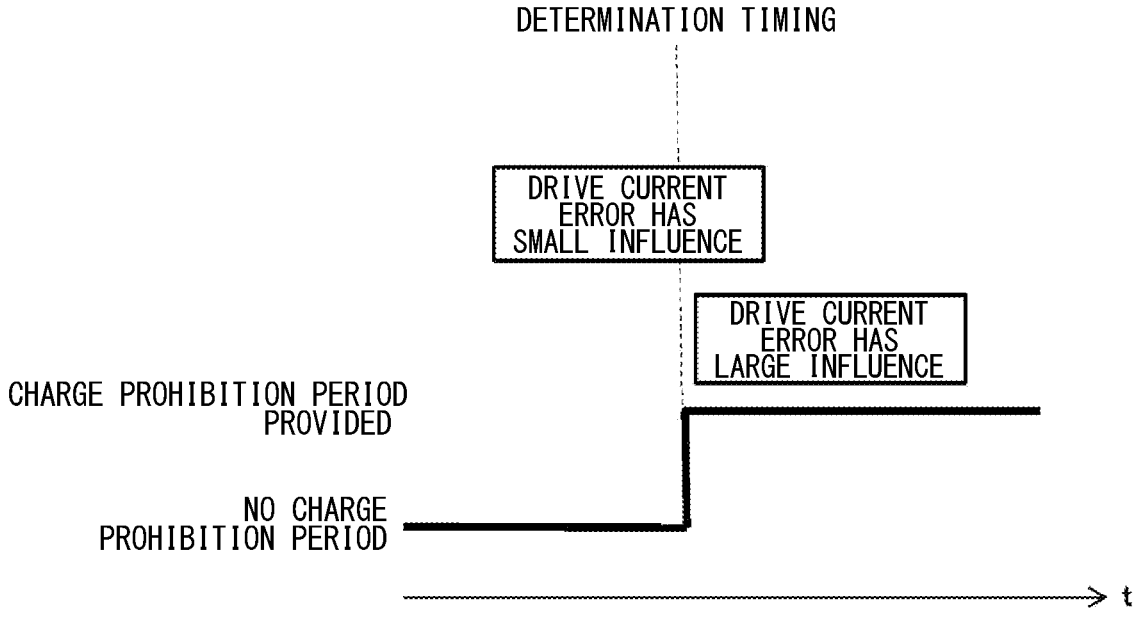
FIG. 5 is a diagram for explaining a charge prohibition period (No. 2)
Figure 6:
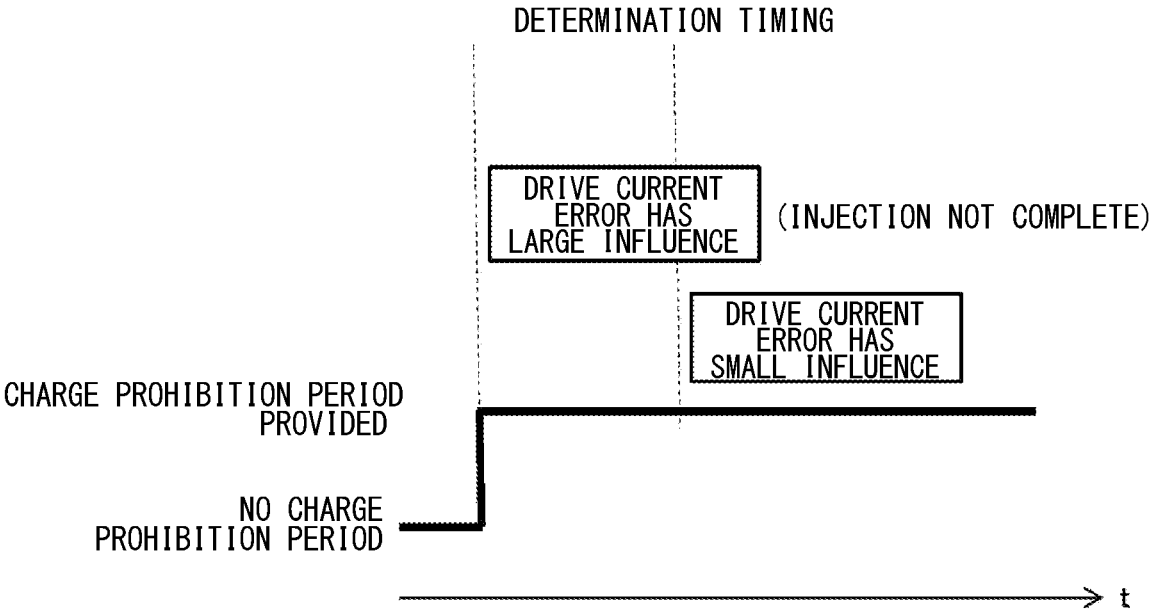
FIG. 6 is a diagram for explaining a charge prohibition period (No. 3)

FIGS. 4-6 describe the situation in which the previous injection end timing and the current injection determination timing are overlapping. For example, in FIG. 4 a region where the drive current error (of the previous injection) has a large influence may overlap a region where the drive current error (of the current injection) has a small influence.

As shown in FIGS. 4 and 5, at the determination timing for determining the current injection, when it is determined that, during charge permission being set to the boost control 5*a*, (A) (i) the current injection is a microinjection or a learning microinjection or (ii) the pulsation of the fuel pressure is equal to or more than a preset level, and (B) the influence of the drive current error on the injection amount is large, the core 10 outputs a charge prohibition instruction to the boost controller 5*a*, and sets, to the boost controller 5*a*, prohibition of charging of the boost circuit 3, and switches charge permission to charge prohibition.

As shown in FIG. 6, at the determination timing for determining the current injection, the core 10 determines that, during charge prohibition being set to the boost controller 5*a*, (i) the drive current error has only a small influence on the injection amount in the current injection, (ii) the drive current error has a large influence on the injection amount in the previous injection, and (iii) the previous injection is not complete, the core 10 outputs a charge prohibition instruction to the boost controller 5*a* for setting charge prohibition of the boost circuit 3 to the boost controller 5*a*, and continues charge prohibition.

Figure 7:
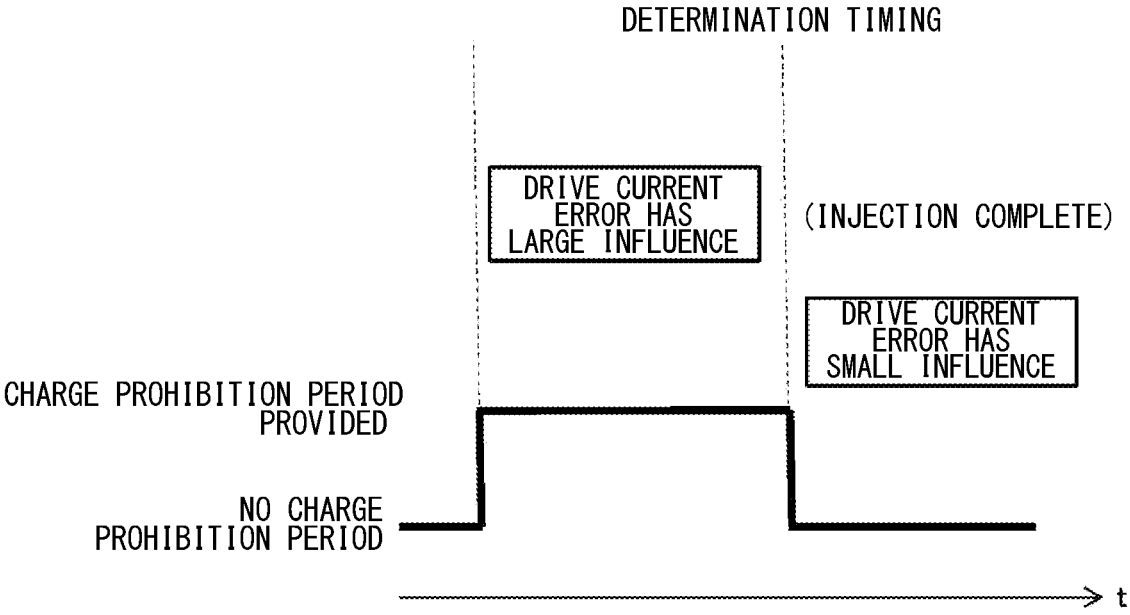
FIG. 7 is a diagram for explaining a charge prohibition period (No. 4)

As shown in FIG. 7, at the determination timing for determining the current injection, when the core 10 determines during charge prohibition being set to the boost controller 5*a* that, (i) the drive current error has a small influence on the injection amount in the current injection, (ii) the drive current error has a large influence on the injection amount in the previous injection, and (iii) the previous injection is complete, the core 10 outputs a charge permission instruction to the boost controller 5*a*, sets, to the boost controller 5*a*, charge permission of to the boost circuit 3, and switches charge prohibition to charge permission.

Figure 8:
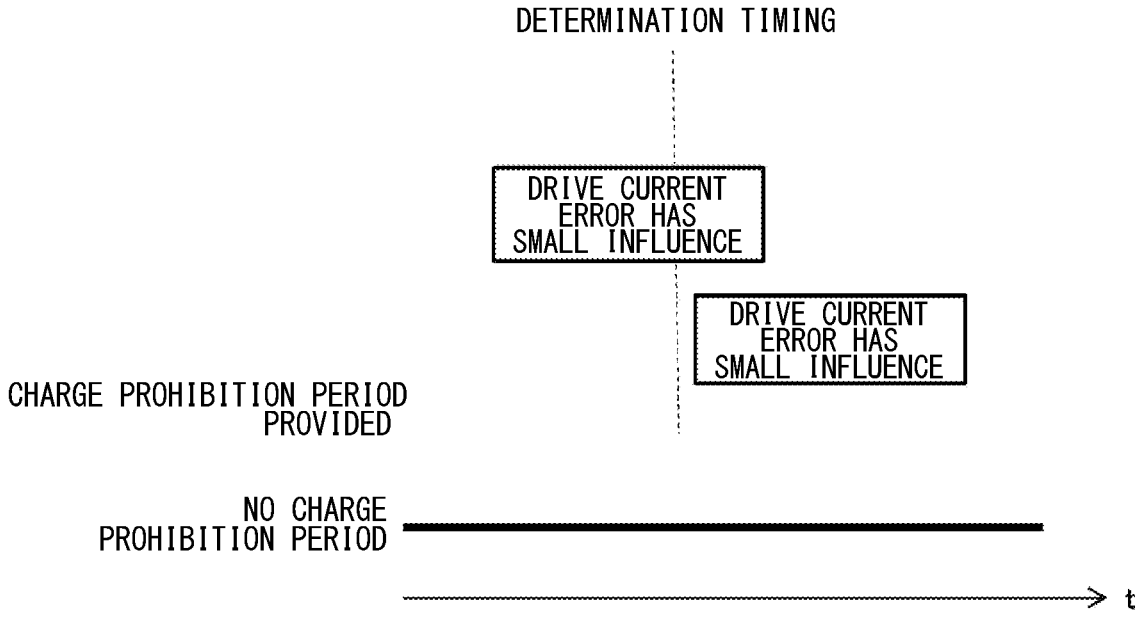
FIG. 8 is a diagram for explaining a charge prohibition period (No. 5)

As shown in FIG. 8, at the determination timing for determining the current injection, when the core 10 determines during charge permission being set to the boost controller 5*a* that, (i) the drive current error has a small influence on the injection amount in the current injection, and (ii) the drive current error has a small influence on the injection amount in the previous injection, the core 10 outputs a charge permission instruction to the boost controller 5*a*, sets, to the boost controller 5*a*, charge permission of the boost circuit 3, and continues charge permission.

(2) The Charge Control Process for each Cylinder

Figure 9:
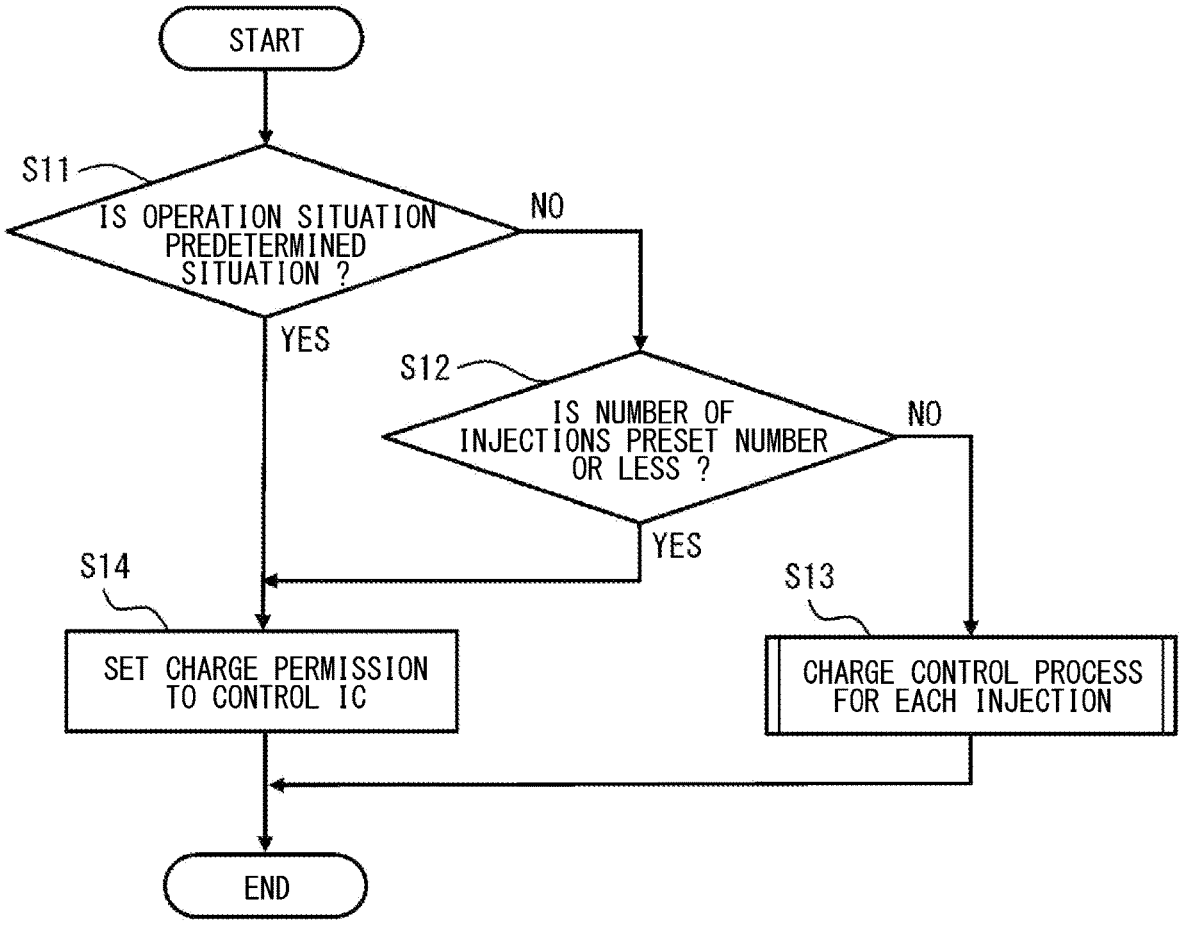
FIG. 9 is a flowchart (No. 2).

In the microcontroller 4, the core 10 starts the charge control process for each cylinder every time a start event for starting the charge control process for each cylinder occurs. As shown in FIG. 9, when the core 10 starts the charge control process for each cylinder, it determines whether or not the operation situation is a predetermined situation (S11). That is, the core 10 determines whether or not the operation situation is any of the extremely low temperature start, the rapid warming of the catalyst, the stratified start, or the fuel-efficiency pursuing stratified combustion. When the core 10 determines that the operation situation is not a predetermined situation (S11: NO), the core 10 compares the number of injections with the preset number, and determines whether or not the number of injections is equal to or less than the preset number (S12).

When the core 10 determines that the number of injections is not less than or equal to the preset number (S12: NO), the core 10 transitions to the charge control process for each injection described above (S13). On the other hand, when the core 10 determines that the operation situation is a predetermined situation (S11: YES) or determines that the number of injections is less than or equal to the preset number (S12: YES), the core 10 outputs a charge permission instruction to the boost controller 5*a*, sets the charge permission of the boost circuit 3 to the boost controller 5*a* (S14), ends the charge control process for each cylinder, and waits for the occurrence of the next start event.

The present embodiment as described above provides the following effects. In the injection control device 1, a selection is made as to whether to prohibit or permit the charging of the boost circuit 3 according to the magnitude of the influence of the drive current error on the injection amount, and when the influence of the drive current error on the injection amount is large, the charging is prohibited by the setting of the charge prohibition set to the boost controller 5*a*, or when the influence of the drive current error on the injection amount is small, the charge permission is set to the boost controller 5*a* to charge or not to charge the boost circuit 3. That is, when the influence of the drive current error on the injection amount is large, charging of the boost circuit 3 is prohibited, so that the influence of the drive current error on the injection amount can be appropriately suppressed and the injection accuracy can be appropriately improved. On the other hand, when the influence of the drive current error on the injection amount is small, the rechargeable time can be appropriately secured by permitting the charging of the boost circuit 3. As a result, it is not necessary to make the boost circuit 3*a* a circuit capable of performing high-speed charging, and while avoiding concerns such as an increase in circuit size and cost, the influence of the drive current error on the injection amount is appropriately suppressed to improve the injection accuracy, as well as appropriately securing the rechargeable time.

Further, the type of injection is determined, and (A) when it is a microinjection or a learning microinjection, it is determined that the influence of the drive current error on the injection amount is large, or (B) when it is neither a microinjection nor a learning microinjection, it is determined that the influence of the drive current error on the injection amount is small, thereby the influence of the drive current error on the injection amount is appropriately suppressed to appropriately improve the injection accuracy, and the rechargeable time is appropriately secured.

Further, the pulsation of the fuel pressure is determined, and when the pulsation of the fuel pressure is equal to or higher than a preset level, it is determined that the influence of the drive current error on the injection amount is large. On the other hand, when the pulsation of the fuel pressure is not equal to or higher than a preset level, it is determined that the influence of the drive current error on the injection amount is small, thereby the influence of the drive current error on the injection amount is appropriately suppressed to appropriately improve the injection accuracy, and the rechargeable time is appropriately secured.

Further, when it is determined that the drive current error has a large influence on the injection amount in the current injection, by switching charge permission to charge prohibition, the influence of the drive current error on the injection amount is appropriately suppressed and the injection accuracy is appropriately improved.

Further, when it is determined that (i) the drive current error has a small influence on the injection amount in the current injection, (ii) the drive current error has a large influence on the injection amount in the previous injection, and (iii) the previous injection is not complete, the influence of the drive current error on the injection amount can be appropriately suppressed and the injection accuracy can be appropriately improved by continuing the charge prohibition.

Further, when it is determined that (i) the drive current error has a small influence on the injection amount in the current injection, (ii) the drive current error has a large influence on the injection amount in the previous injection, and (iii) the previous injection is complete, the rechargeable time can be appropriately secured by switching charge prohibition to charge permission.

Further, when it is determined that the operation situation is a predetermined situation i.e., is any of the extremely low temperature start, the rapid warming of the catalyst, the stratified start, or the fuel-efficiency pursuing stratified combustion, by determining that the influence of the drive current error on the injection amount is uniformly small, the rechargeable time can be appropriately secured. Further, when it is determined that the number of injections is less than or equal to a preset number, it is determined that the influence of the drive current error on the injection amount is uniformly small, thereby the rechargeable time can be appropriately secured.

The above-mentioned microcontroller 4 and control IC 5 may be integrated, and in such case, it is desirable to use an arithmetic processing unit capable of performing high-speed calculation. The means and functions provided by the microcontroller 4 and the control IC 5 can be provided as software stored in a substantive memory device and a computer that executes the software, as software, as hardware, or as a combination thereof. For example, when a control device is provided by an electronic circuit which is hardware, it can be configured as a digital circuit or an analog circuit including one or more logic circuits. Further, for example, when the control device executes various controls by using software, a program is stored in the storage unit, and the controlling subject executes the program to implement a method corresponding to the program.

In addition, various changes can be made to the hardware configuration of the fuel injection valve, boost circuit, drive circuit, current detector, and the like. Although the present disclosure has been described in accordance with the examples, it is understood that the disclosure is not limited to such examples or structures. The present disclosure incorporates various modifications and variations within the scope of equivalents. Furthermore, various combinations and formations, and other combinations and formations including one, more than one or less than one element may be included in the scope and the spirit of the present disclosure.

The control device and method described in the present disclosure may be implemented by a special purpose computer which includes a memory and a processor programmed to perform one or more functions embodied as computer programs stored in the memory. Alternatively, the control device and method described in the present disclosure may also be implemented by a special purpose computer which includes a processor with one or more dedicated hardware logic circuits. Alternatively, the controller and method described in the present disclosure may be implemented by one or more special purpose computers, which is configured as a combination of (i) a processor and a memory, which are programmed to perform one or more functions, and (ii) a processor with one or more hardware logic circuits. Further, a computer program may also be stored in a computer-readable, non-transitory, tangible storage medium as instructions to be executed by a computer.

What is claimed is:

1. An injection control device that controls fuel injection to an internal-combustion engine by driving a fuel injection valve with an electric current to open and close the valve, the injection control device comprising:

a boost circuit boosting a battery voltage;

a boost controller controlling the boosting of the boost circuit; and a charge control setter setting a charge permission or a charge prohibition of the boost circuit to the boost controller, wherein the charge control setter sets the charge prohibition of the boost circuit to the boost controller when at least one large influence condition in a set of large influence conditions is satisfied, wherein the set of large influence conditions includes:

(i) a determination that a current injection is a microinjection;

(ii) a determination that the current injection is a learning microinjection; and (iii) a determination that a measured pulsation of fuel pressure is greater than or equal to a pulsation preset level, and wherein the charge control setter sets a charge permission of the boost circuit to the boost controller when none of the large influence conditions are satisfied.

2. The injection control device of claim 1 further comprising:

an influence determiner that determines whether the at least one of the large influence conditions is satisfied.

3. The injection control device of claim 2 further comprising:

an injection completion determiner determining whether or not a previous injection is complete, wherein, (i) when it is determined by the influence determiner that at least one large influence condition in the set of large influence conditions was satisfied in the previous injection, the charge prohibition having been set by the charge control setter, and (ii) when it is determined by the injection completion determiner that the previous injection is not complete, the charge control setter continues the charge prohibition.

4. The injection control device of claim 2 further comprising:

an injection completion determiner determining whether or not a previous injection is complete, wherein, (i) when it is determined by the injection completion determiner that the previous injection is complete, (ii) when it is determined by the influence determiner that at least one large influence condition in the set of large influence conditions was satisfied in the previous injection, the charge prohibition having been set by the charge control setter, and (iii) when it is determined by the influence determiner that none of the large influence conditions are satisfied in the current injection, the charge control setter switches the charge prohibition to the charge permission.

5. The injection control device of claim 1, wherein the charge control setter switches the charge permission to the charge prohibition when it is determined that the at least one of the large influence conditions is satisfied in the current injection during the charge permission being set to the boost controller.

6. The injection control device of claim 1, further comprising:

an operation situation determiner determining whether or not an operation situation is a predetermined situation, wherein the charge control setter sets the charge permission to the boost controller when it is determined that the operation situation is a predetermined situation.

7. The injection control device of claim 1, further comprising:

an injection number determiner determining whether or not a number of injections is equal to or less than a preset number, wherein the charge control setter sets the charge permission to the boost controller when it is determined that the number of injections is equal to or less than a preset number.

* * * * *